US009982495B1

(12) United States Patent
Menduni

(10) Patent No.: US 9,982,495 B1
(45) Date of Patent: May 29, 2018

(54) TUBULAR HANDLING ASSEMBLY AND METHOD

(71) Applicants: Expert E&P Consultants, LLC, Madisonville, LA (US); Michael Joseph Menduni, Golden Meadow, LA (US)

(72) Inventor: Michael Joseph Menduni, Houma, LA (US)

(73) Assignee: William von Eberstein, Madisonville, LA (US)

( * ) Notice: Subject to any disclaimer, the term of this patent is extended or adjusted under 35 U.S.C. 154(b) by 0 days. days.

(21) Appl. No.: 15/648,160

(22) Filed: Jul. 12, 2017

(51) Int. Cl.

| | |
|---|---|
| ***E21B 17/01*** | (2006.01) |
| ***E21B 17/10*** | (2006.01) |
| ***E21B 19/00*** | (2006.01) |
| ***E21B 33/038*** | (2006.01) |
| ***E21B 33/037*** | (2006.01) |

(52) U.S. Cl.
CPC ..... *E21B 19/004* (2013.01); *E21B 17/01* (2013.01); *E21B 33/037* (2013.01); *E21B 33/038* (2013.01)

(58) Field of Classification Search
CPC ..... E21B 17/01; E21B 17/006; E21B 17/10; E21B 19/004; E21B 33/037; E21B 33/038; B65D 59/00; F16L 57/005
See application file for complete search history.

(56) References Cited

U.S. PATENT DOCUMENTS 3,463,196 A * 8/1969 Richardson ..... B65D 59/00 138/96 R
3,856,050 A * 12/1974 Rooney ..... F16L 57/005 138/96 R
3,942,681 A * 3/1976 Richardson ..... F16L 57/005 138/96 R
4,014,368 A * 3/1977 Nelsen ..... B65D 59/02 138/109
4,159,135 A * 6/1979 Richardson ..... E21B 33/06 285/336
4,423,753 A * 1/1984 Smith ..... F16L 57/005 138/89
4,915,137 A * 4/1990 Hall ..... F16L 23/003 138/89
5,707,168 A * 1/1998 Sharon ..... B66C 1/62 294/67.2
5,844,127 A * 12/1998 Berube ..... G01M 3/022 138/89

(Continued)

*Primary Examiner* — Matthew R Buck
(74) *Attorney, Agent, or Firm* — Jones Walker LLP

(57) ABSTRACT

An assembly for handling a tubular member disposed in a central bore of a riser. The assembly includes adapter bushings configured to be positioned within auxiliary bores of the riser flange, tie rods that threadedly engage a central bore of the adapter bushings, and a frame including guides through which the tie rods slide to suspend the frame. The frame slides along the tie rods and at least partially over the tubular member to engage a free end of the tubular member with an end stop of the frame. One or more grip blocks extend through lateral bores in the frame to grip a recess in an outer surface of the tubular member, and the grip blocks are locked in position. With the tubular member locked within the frame, the tubular may be removed from the central bore of the riser and/or inserted into the central bore of the riser.

18 Claims, 10 Drawing Sheets

(56) References Cited

U.S. PATENT DOCUMENTS

| | | | | |
|---|---|---|---|---|
| 5,866,218 | A * | 2/1999 | Meuth | B65D 59/02 428/36.5 |
| 6,532,992 | B1 * | 3/2003 | Holden | F16L 57/005 138/89 |
| 7,347,455 | B1 * | 3/2008 | Taquino | E21B 17/006 138/89 |
| 8,118,091 | B2 * | 2/2012 | Baker | B65D 59/02 138/89 |
| 8,443,844 | B2 * | 5/2013 | Zeyfang | F16L 57/005 138/96 R |
| 8,671,991 | B2 * | 3/2014 | Zeyfang | F16L 57/005 138/96 R |
| 2012/0006557 | A1 * | 1/2012 | Fraser | E21B 33/038 166/350 |
| 2012/0261024 | A1 * | 10/2012 | Ketzer | F16L 23/003 138/96 R |
| 2012/0273212 | A1 * | 11/2012 | Anderson | E21B 33/038 166/340 |

* cited by examiner

TUBULAR HANDLING ASSEMBLY AND METHOD

DETAILED DESCRIPTION OF SELECTED EMBODIMENTS

Marine risers are used with subsea oil and gas wells. A marine riser string generally extends from the surface of a wellbore at the ocean floor to a drilling rig or platform positioned above the water's surface. The riser string effectively extends the subsea wellbore to the rig or platform. The riser string is formed of riser segments, with each segment including a flange at each end. The riser segments are connected by securing the flanges of adjacent riser segments together. Seal subs are positioned within the central bores of two adjacent riser segments to seal the junction between the two flanges. Because of its substantial weight, the conventional method of installing and removing a seal sub from the central bore of a riser segment presents safety risks for operators.

A tubular handling assembly disclosed herein stabilizes a tubular member (e.g., a seal sub) to reduce safety risks and facilitate assembly and disassembly. The tubular handling assembly may be used to install the tubular member in the central bore of the riser segment. The tubular handling assembly may also be used to partially or completely remove the tubular member from the central bore.

Figure 1:
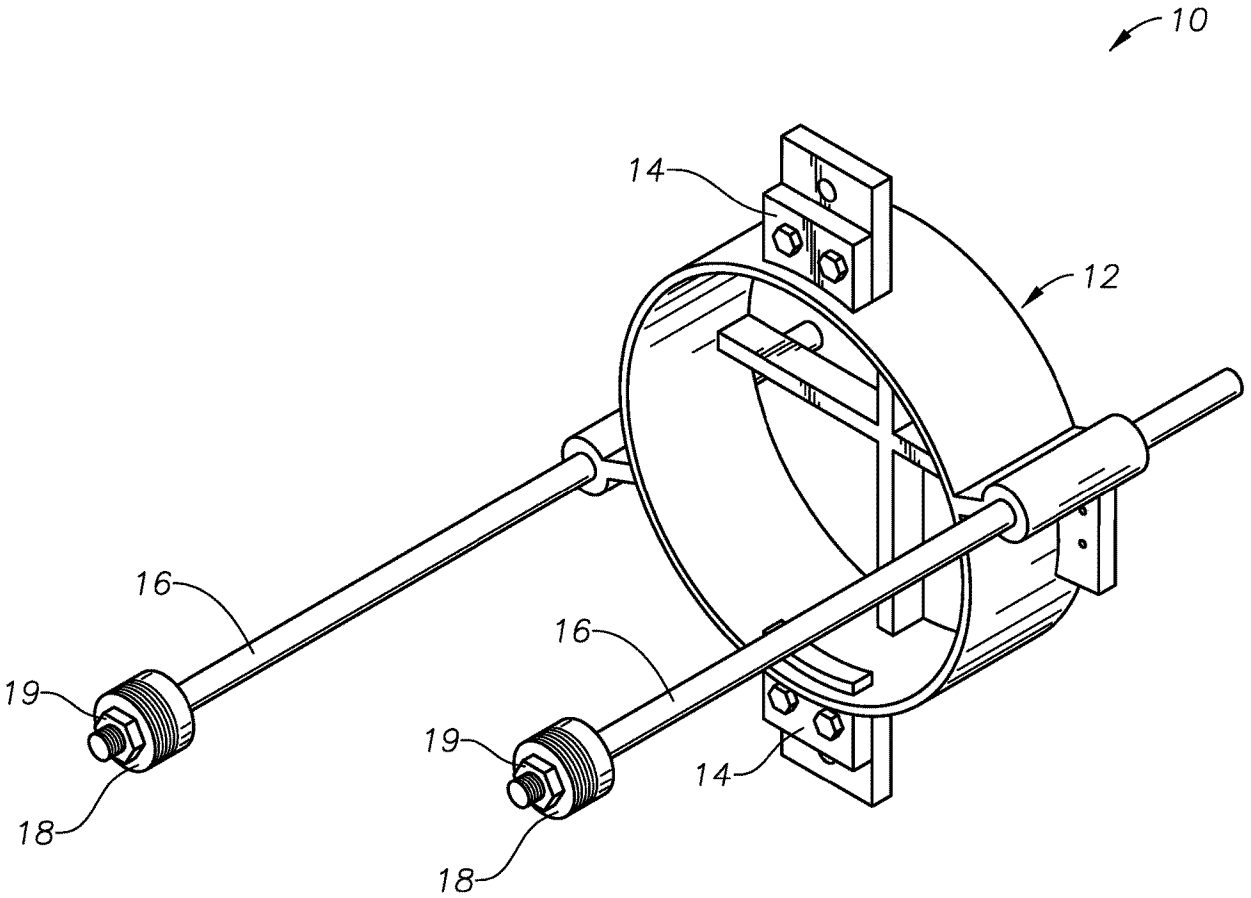
FIG. 1 is a perspective view of a tubular handling assembly.
Figure 2:
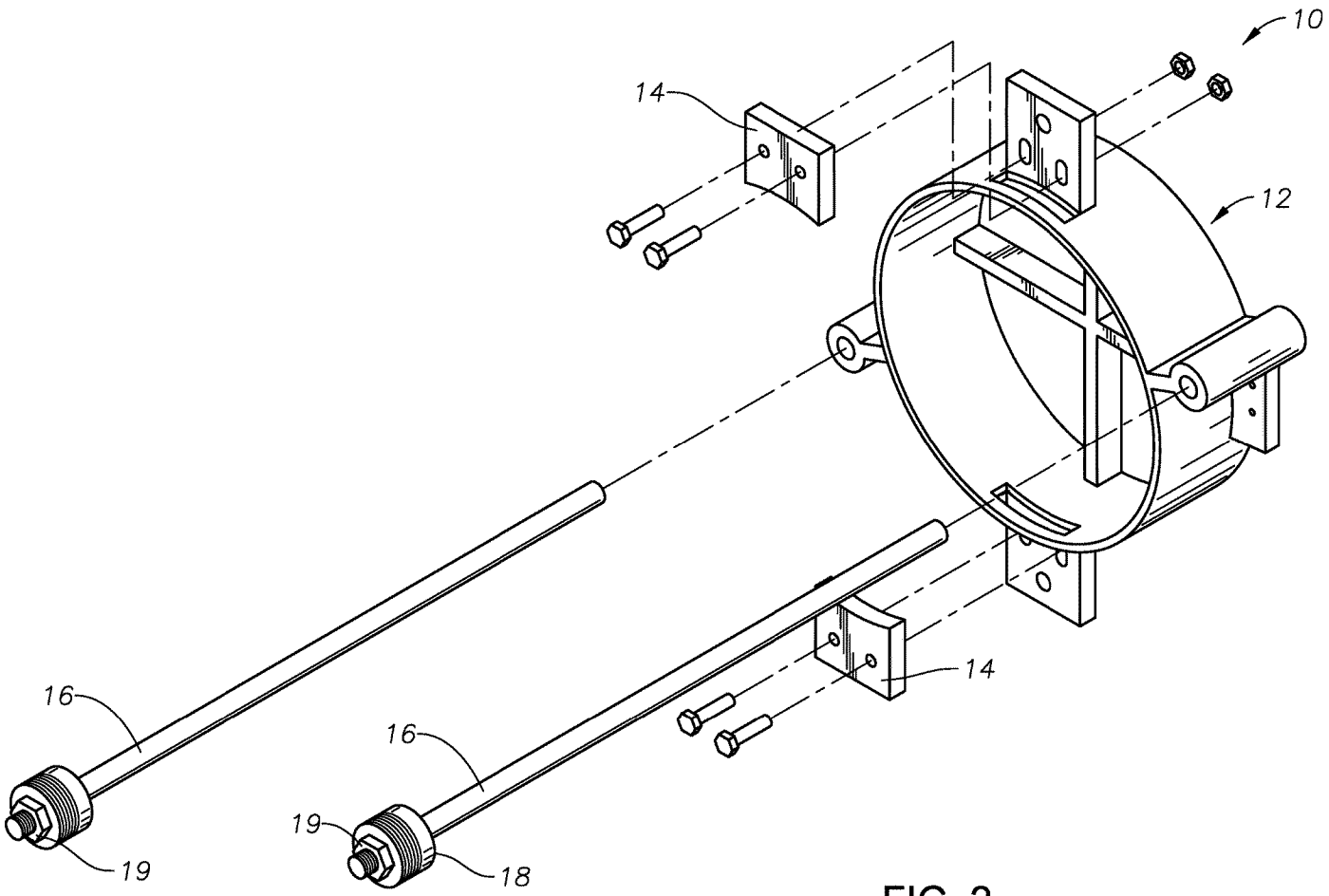
FIG. 2 is an exploded perspective view of the tubular handling assembly.

In one embodiment illustrated in FIGS. 1 and 2, tubular handling assembly 10 includes frame 12 with grip blocks 14 slidingly connected to frame 12. Frame 12 is slidingly mounted on tie rods 16. An adapter bushing 18 is threadedly connected to each tie rod 16. A tie rod nut 19 may also be threadedly connected to each tie rod 16 to secure adapter bushing 18 to tie rod 16. Each adapter bushing 18 is configured to be positioned within an auxiliary bore of a riser flange, as explained more fully below. Adapter bushings 18 operatively secure tie rods 16 within the auxiliary bores. Alternatively, tie rods 16 may be secured directly into the auxiliary bores of the riser flange. Frame 12 may slide along tie rods 16 toward and away from the riser flange to engage a tubular member positioned in the central bore of the riser using grip blocks 14.

Figure 3:
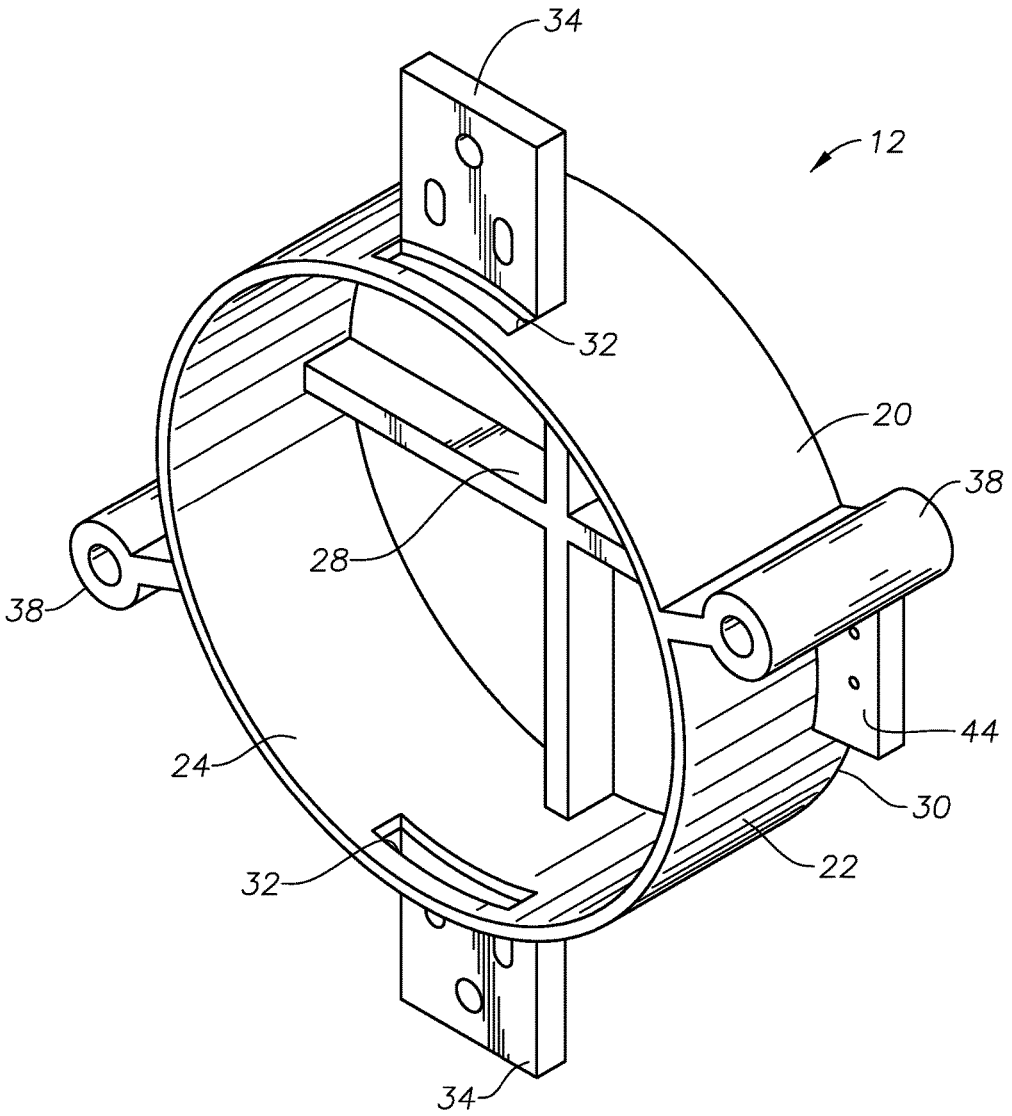
FIG. 3 is a perspective view of a frame of the tubular handling assembly.
Figure 4:
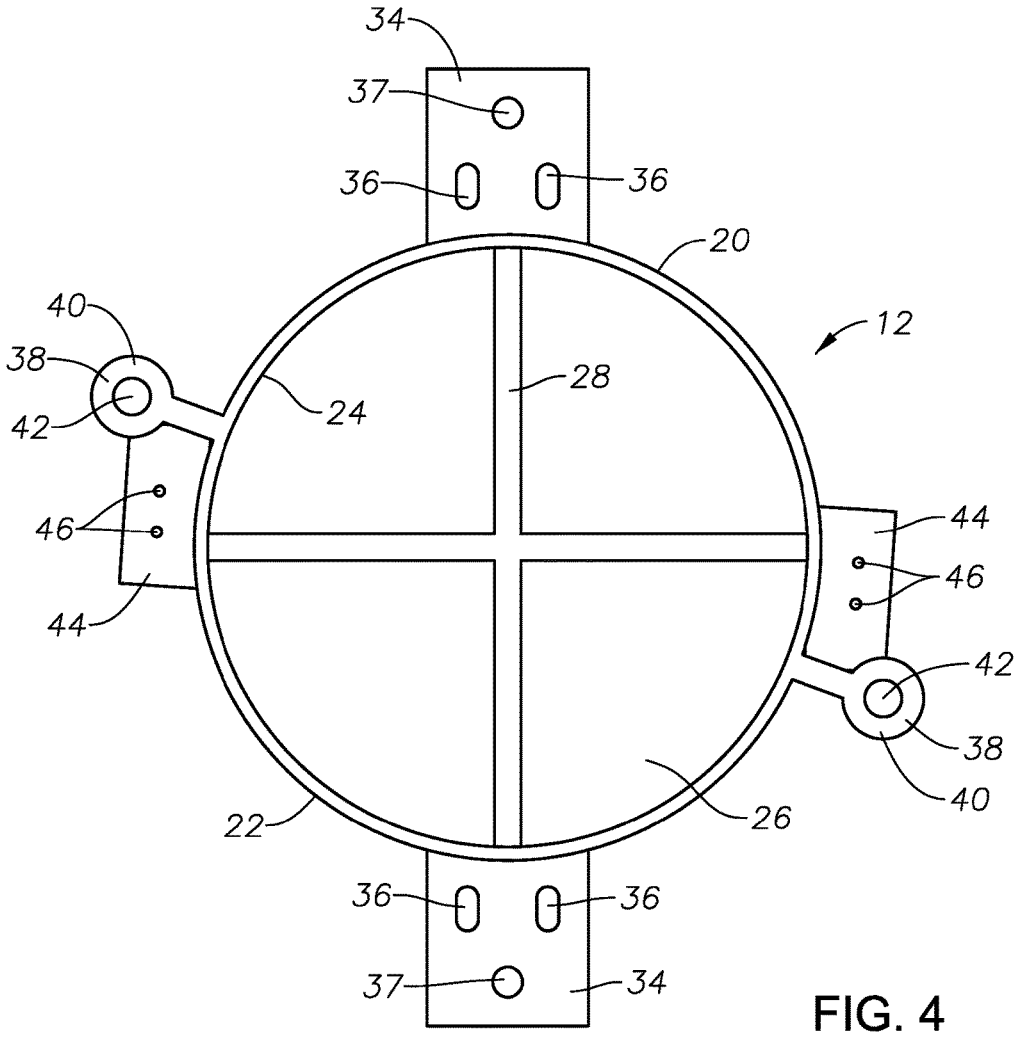
FIG. 4 is an end view of the frame.

Referring now to FIGS. 3 and 4, frame 12 includes sleeve 20. As used herein, "sleeve" means any tubular member or any pipe section that slides at least partially over another tubular member or pipe section. In the embodiment illustrated in FIGS. 3 and 4, sleeve 20 includes outer surface 22, inner surface 24 defining internal space 26, and end stop 28 positioned at first end 30 of sleeve 20. End stop 28 may include a beam extending across the diameter of sleeve 20, cross-beams extending across the diameter of sleeve 20 as shown in FIGS. 3-4, a shoulder extending from inner surface 24 of sleeve 20 partially into internal space 26, a reduced diameter section of inner surface 24, or any other mechanism configured to block a tubular member from moving completely through internal space 26. In certain embodiments in which end stop 28 is formed of a beam or cross-beams extending across the diameter of sleeve 20, the beam or cross-beam may include a uniform height or a variable height across the diameter of sleeve 20.

Sleeve 20 may include one or more lateral apertures 32 and one or more ears 34, with each ear 34 extending from outer surface 22 of sleeve 20 proximate one of lateral apertures 32. Each ear 34 may include an ear securing mechanism, such as openings 36 configured to receive bolts (shown in FIGS. 1-2 and 9-11). Openings 36 may each have a round shape or a shape that is elongated in a radial direction relative to sleeve 20. Optionally, each ear 34 includes lift opening 37 to facilitate the transport of frame 12 by allowing a hook, rope, cable or other fastening device to engage lift opening 37 for lifting frame 12. Sleeve 20 also includes two guides 38, each extending from outer surface 22. Guides 38 may be positioned on opposite sides of sleeve 20. As used herein, "opposite" means positioned about 180 degrees apart along the outer surface of sleeve 20. Each guide 38 may include tubular frame 40 with internal bore 42. Mount surface 44 may extend from outer surface 22 of sleeve 20, and may include one or more openings 46. In one embodiment, mount surface 44 is proximate one of guides 38. In a further embodiment, sleeve 20 includes two mount surfaces 44, each proximate one of guides 38. Mount surface 44 may be formed of a plate, beam, shoulder, or any other structure providing a lateral surface extending from outer surface 22 of sleeve 20. "Lateral" as used herein means extending along or being oriented in a radial direction relative to sleeve 20. Sleeve 20 may have a length between 8 inches and 12 inches, or any subrange therein, and an outer diameter between 18 inches and 24 inches, or any subrange therein. Sleeve 20 and all of its components described herein may be formed of aluminum or carbon steel.

Figure 5:
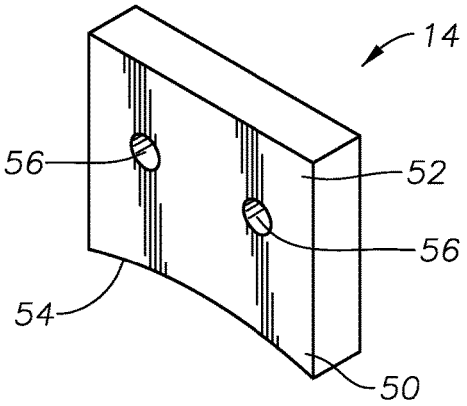
FIG. 5 is a perspective view of a grip block of the tubular handling assembly.

Referring now to FIG. 5, grip block 14 extends from first end 50 to second end 52. First end 50 may be dimensioned to slide through lateral aperture 32 of sleeve 20 to engage a tubular member positioned at least partially within internal space 26 of frame 12. For example, the width and thickness (or height) of grip block 14 may be less than a width and height (or thickness) of lateral aperture 32, respectively. In one embodiment, first end 50 includes curved end profile 54. Grip block 14 may also include a grip securing mechanism, such as openings 56 configured to receive bolts. The grip securing mechanism of grip block 14 is configured to cooperate with the ear securing mechanism of ear 34 to immobilize grip block 14 relative to ear 34. In the embodiment illustrated in FIGS. 4 and 5, a bolt or other securing device is positioned through opening 36 of ear 34 and openings 56 of grip block 14 when the openings are aligned. In this way, first end 50 of grip block 14 is secured within aperture 32 of frame 12. Grip block 14 may be generally formed of a plate, block, beam, or any other structure having the features described. Grip block may have a width and length between 5 inches and 8 inches, or any subrange therein, and a thickness between 0.5 inches and 2 inches, or any subrange therein. Grip block may be formed of aluminum or carbon steel.

Figure 6:
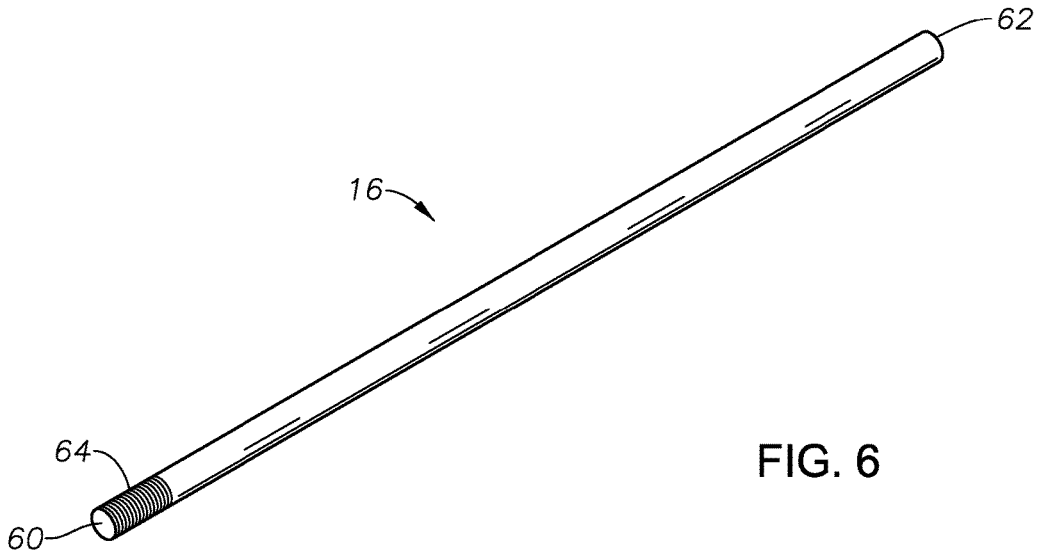
FIG. 6 is a perspective view of a tie rod of the tubular handling assembly.

With reference to FIG. 6, tie rod 16 extends from first end 60 to second end 62. Tie rod 16 includes threaded outer surface 64 adjacent to first end 60. Threaded outer surface 64 extends a partial distance along the length of tie rod 16 (e.g., less than the full length of tie rod 16). Tie rod 16 is dimensioned to slidingly engage internal bore 42 of guide 38 on frame 12 to suspend frame 12 on tie rod 16. Tie rod 16 may have a diameter between 1 inch and 2 inches, or any subrange therein. Tie rod 16 may have a length between 18 inches and 48 inches, or any subrange therein. In one embodiment, threaded outer surface 64 extends between 1 inch and 2.5 inches from first end 60, or any subrange therein. Tie rod 16 may be formed of carbon steel.

Figure 7:
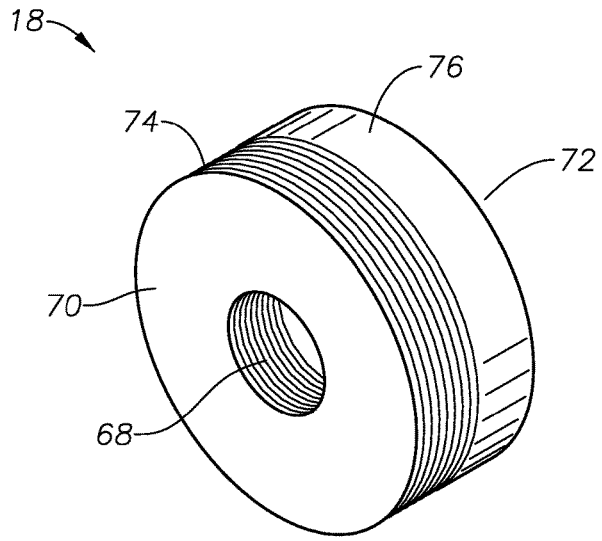
FIG. 7 is a perspective view of an adapter bushing of the tubular handling assembly.

Referring to FIG. 7, adapter bushing 18 includes threaded inner bore 68 extending from first end 70 to second end 72. Threaded inner bore 68 is dimensioned to receive tie rod 16 therethrough. Specifically, threaded inner bore 68 is configured to threadedly engage threaded outer surface 64 of tie rod 16. The outer surface of adapter bushing 18 includes threaded portion 74 adjacent to first end 70 and non-threaded portion 76 adjacent to second end 72. Threaded portion 74 of adapter bushing 18 is dimensioned to threadedly engage an inner threaded surface of an auxiliary bore in a riser flange. Threaded portion 74 and non-threaded portion 76 may have the same outer diameter. Adapter bushing 18 may have a length between 1.5 inches and 4 inches, or any subrange therein, and a diameter between 2 inches and 5 inches, or any subrange therein. Threaded inner bore 68 may have a diameter between 1 inch and 2 inches, or any subrange therein. Threaded portion 74 may extend between 1.5 inches and 4 inches from first end 70. Adapter bushing 18 may be formed of alloy 6061 aluminum or ASTM 50 KSI carbon steel. In one embodiment, adapter bushing 18 is integrally formed with or secured to (e.g., by welding or other fastening method) tie rod 16.

Figure 8:
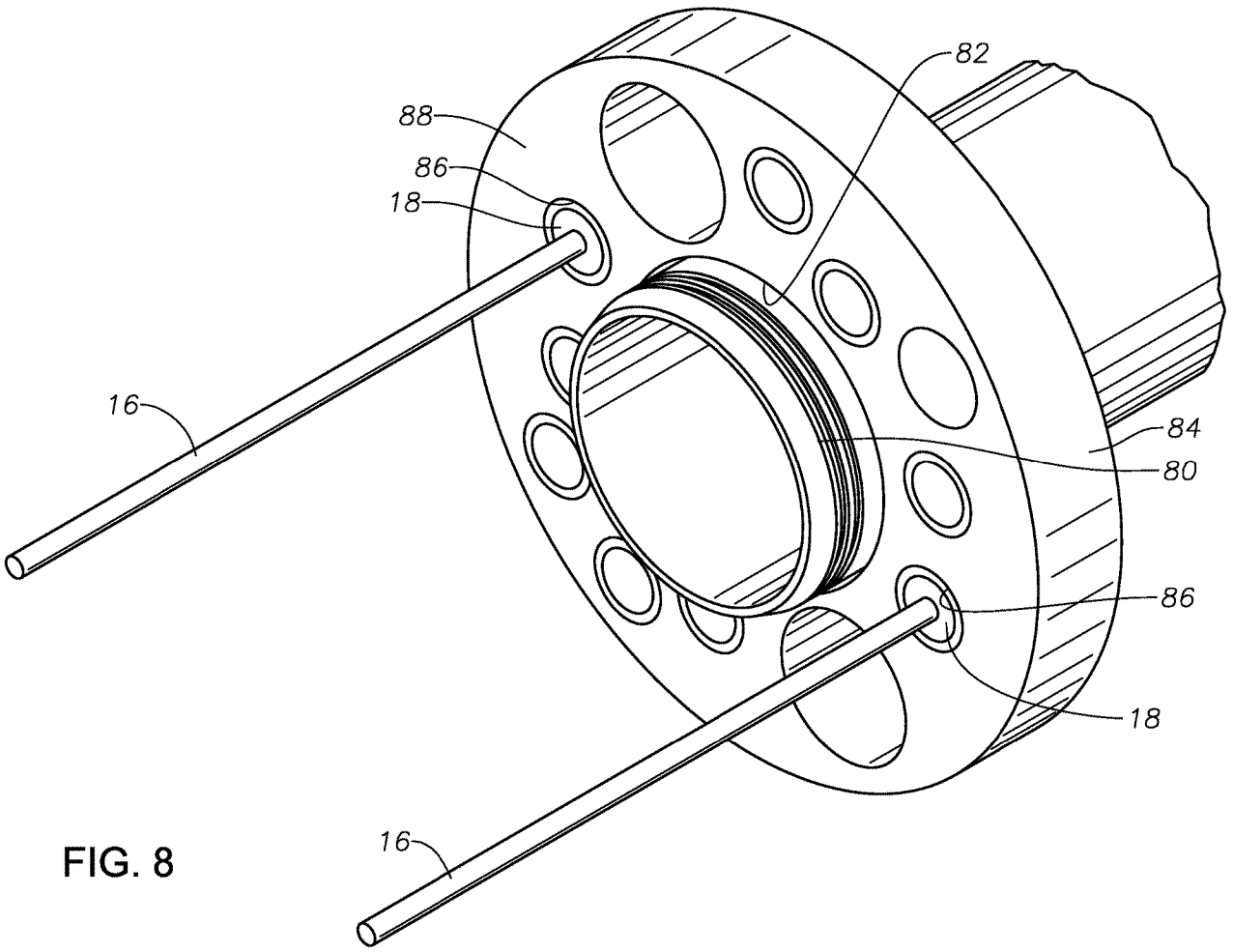
FIG. 8 is a perspective view of the adapter bushings and tie rods of the tubular handling assembly attached within auxiliary bores of a riser segment.

FIG. 8 illustrates tubular 80 disposed within central bore 82 of riser segment 84. A method of handling tubular 80 may include securing one adapter bushing 18 on each tie rod 16. Specifically, threaded inner bore 68 of adapter bushing 18 may engage threaded outer surface 64 of tie rod 16 until threaded inner bore 68 reaches the end of threaded outer surface 64. Tie rod nuts 19 (shown in FIG. 1) may be threadedly connected to threaded outer surface 64 of each tie rod 16 to secure adapter bushing 18 on each tie rod 16. Adapter bushing 18 and tie rod 16 may then be secured within auxiliary bores 86 in riser flange 88. An inner surface of auxiliary bore 86 may include a non-threaded portion and a threaded portion, with the threaded portion having a smaller inner diameter than the non-threaded portion. First end 70 of adapter bushing 18 may be inserted into the non-threaded portion of auxiliary bore 86 until first end 70 of adapter bushing 18 reaches the threaded portion of auxiliary bore 86. Adapter bushing 18 may then be threadedly connected within auxiliary bore 86 by rotating adapter bushing 18 to engage threaded surface 74 of adapter bushing 18 with the threaded portion of auxiliary bore 86 until non-threaded surface 76 reaches the threaded portion of auxiliary bore 86. In this position, first end 60 of each tie rod 16 may or may not extend beyond a rear surface of riser flange 88.

Figure 9:
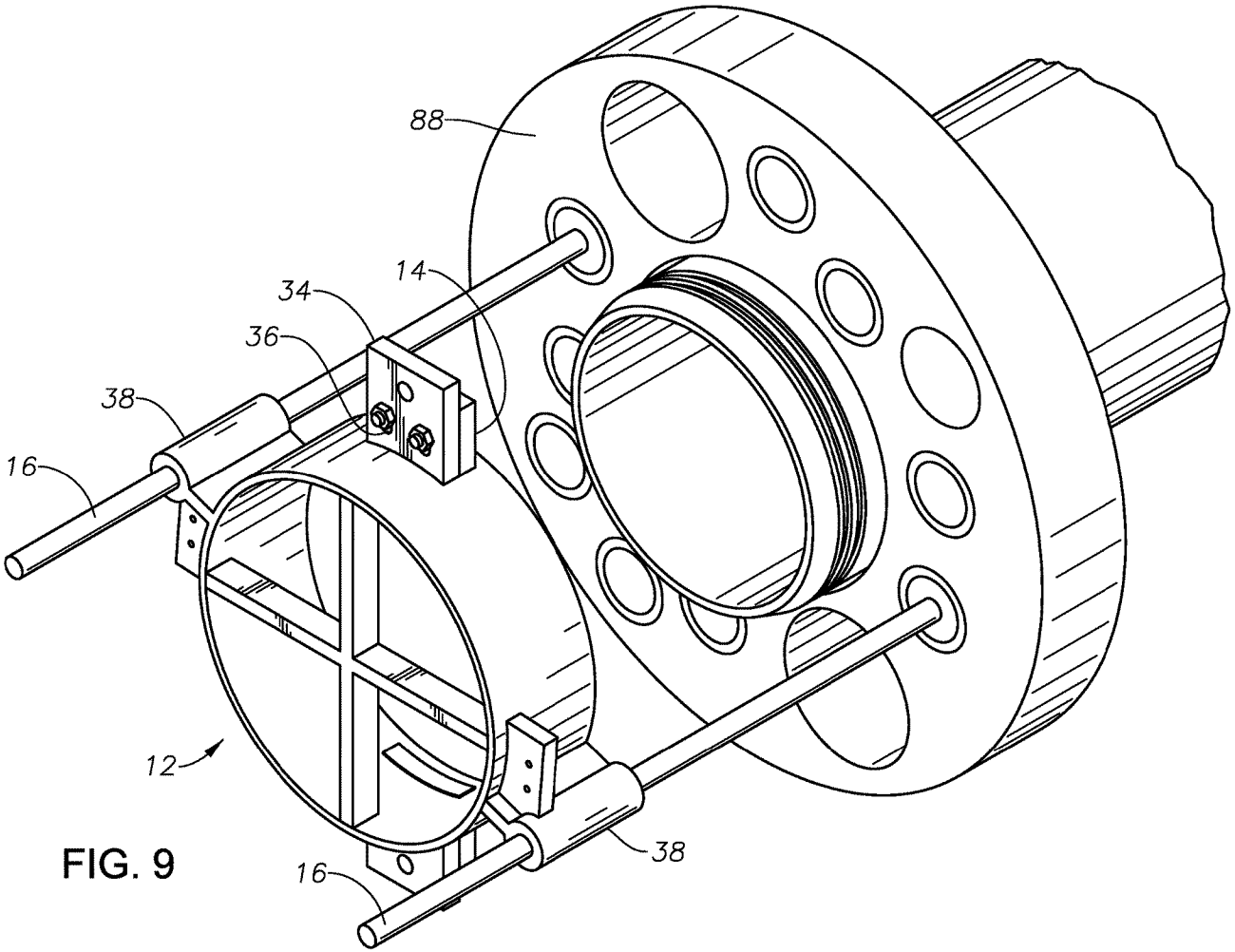
FIG. 9 is a sequential perspective view of the frame suspended on the tie rods.

With reference to FIG. 9, one or more grip blocks 14 may be secured to frame 12 by inserting first end 50 of each grip block 14 at least partially into one of lateral apertures 32. When openings 56 in grip block 14 align with openings 36 in ears 34, a bolt or other securing device may be secured through openings 56, 36 to fix grip block 14 relative to frame 12. In certain embodiments in which openings 36 have an elongated shape, grip block 14 may be placed in an installation position by positioning grip block 14 such that openings 56 are aligned with a distal end of each opening 36 of ears 34 (i.e., the end of each opening 36 that is farthest from outer surface 22 of sleeve 20) as illustrated in FIG. 9. In these ways, grip blocks 14 may be secured to frame 12. Frame 12 with attached grip blocks 14 may be suspended on tie rods 16 by positioning each tie rod 16 through internal bore 42 of each guide 38.

Figure 10:
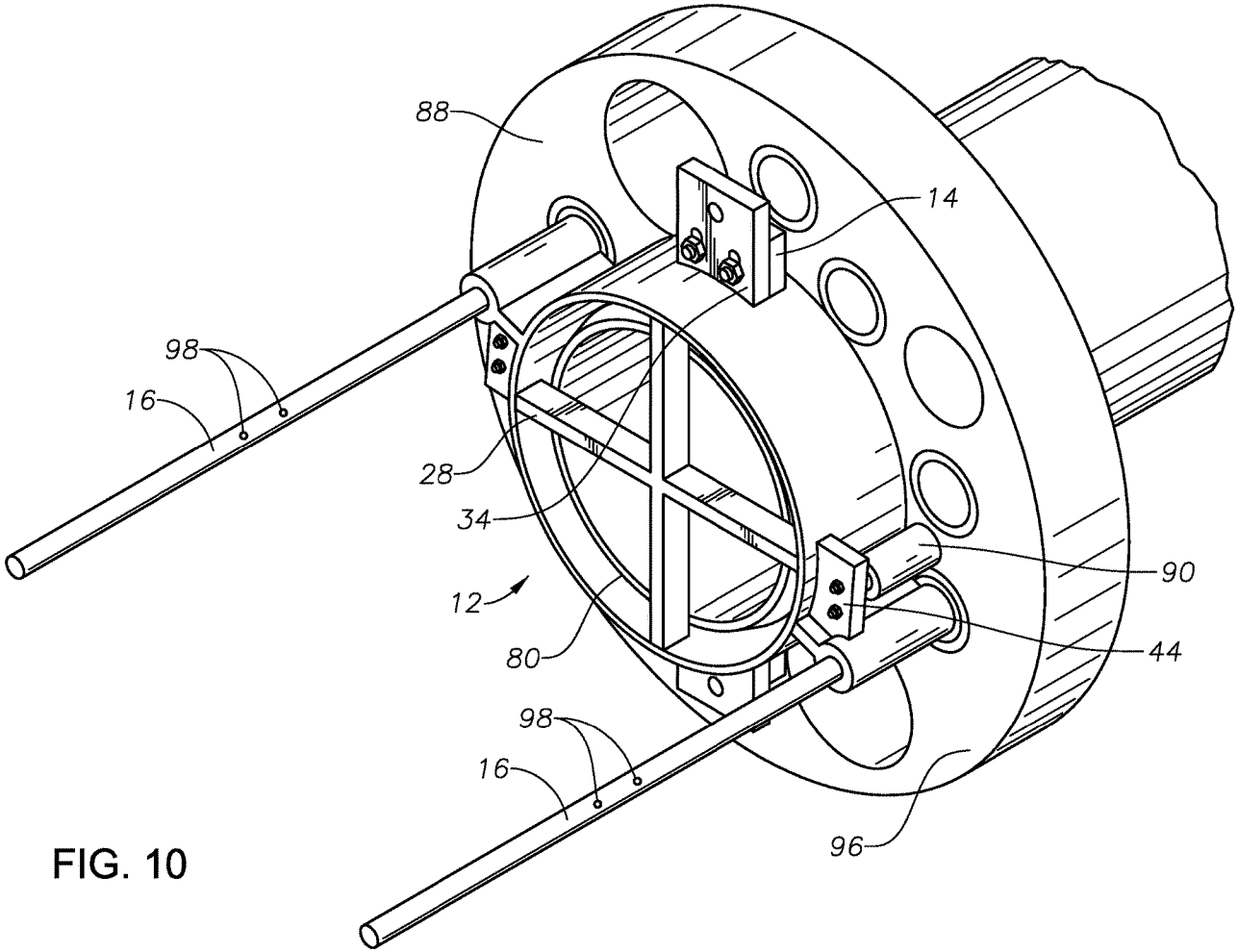
FIG. 10 is a sequential perspective view of the frame locked over a tubular member disposed within a central bore of the riser segment.

Referring now to FIG. 10, hydraulic cylinder unit 90 may be affixed to a rear side of each mount surface 44 of frame 12 to position hydraulic cylinder unit 90 between mount surface 44 and riser flange 88. Hydraulic cylinder unit 90 may be secured to mount surface 44 by securing bolts or other securing devices through openings 46 of mount surface 44. In an alternate embodiment, a pneumatic unit (or any other expanding unit) may be secured to the rear side of each mount surface 44 of frame 12 instead of hydraulic cylinder unit 90.

Frame 12 may be moved along tie rods 16 until end stop 28 of frame 12 engages the free end of tubular 80. The bolts or other securing devices within openings 56, 36 may be loosened to allow grip blocks 14 to slide within lateral aperture 32 relative to ears 34. In certain embodiments including openings 36 having an elongated shape, the bolts or other securing devices remain within openings 36 and are free to slide in the radial direction within openings 36 to further insert grip blocks 14 through lateral apertures 32.

Figure 11:
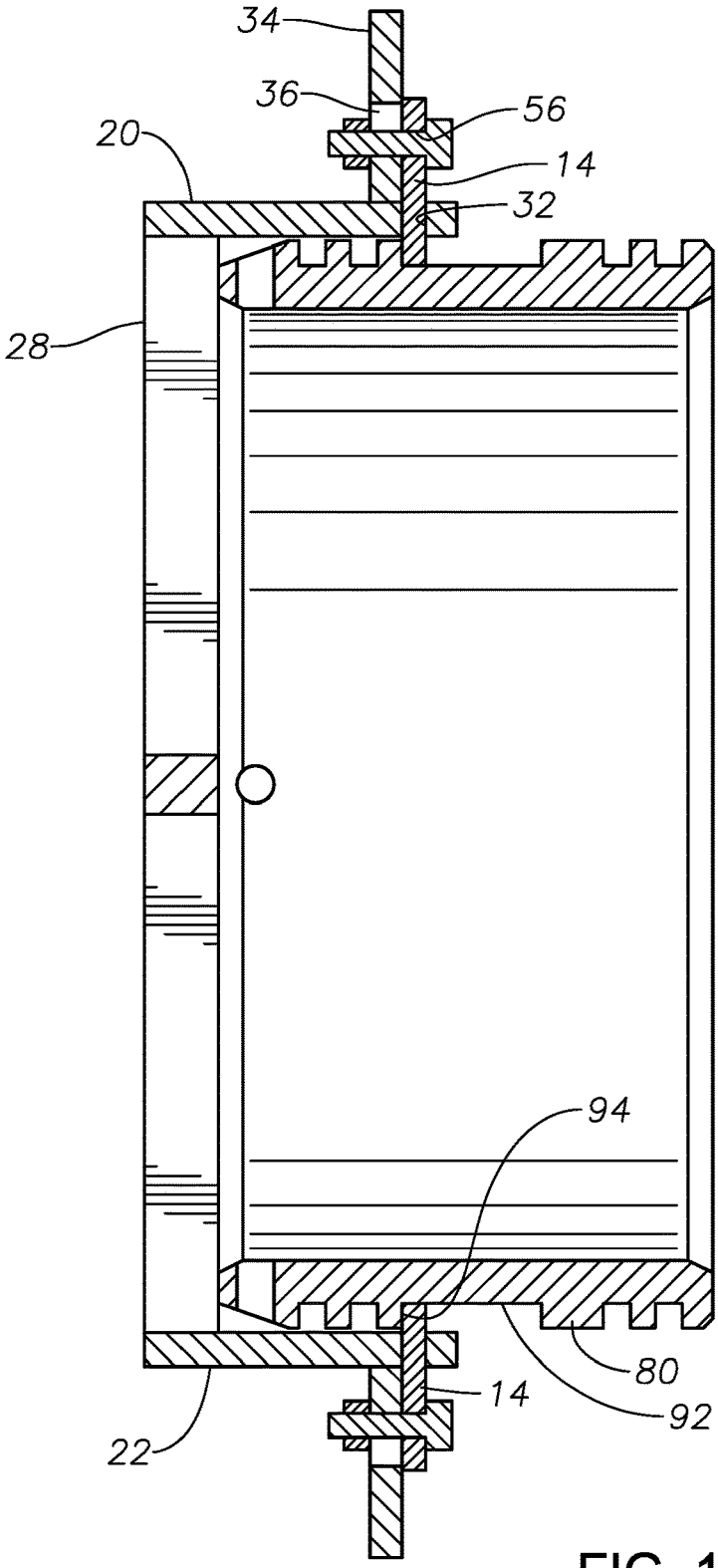
FIG. 11 is a sectional view of the frame locked over the tubular member disposed within the central bore of the riser segment.

As shown in FIG. 11, grip blocks 14 may be inserted further through lateral apertures 32 until first end 50 of grip block 14 engages recess 92 of tubular 80 disposed within interior space 26 of sleeve 20. In this position, grip block 14 may also engage forward shoulder 94 of recess 92 of tubular 80. In one embodiment, first end 50 of grip block 14 includes curved end profile 54, which engages a curved outer surface of tubular 80. With grip block 14 engaging tubular 80, the bolts or other securing devices within openings 56, 36 may be tightened again to immobilize grip blocks 14 relative to ears 34. In this way, frame 12 grips recess 92 of tubular 80 to secure tubular 80 within interior space 26 of sleeve 20.

Figure 12:
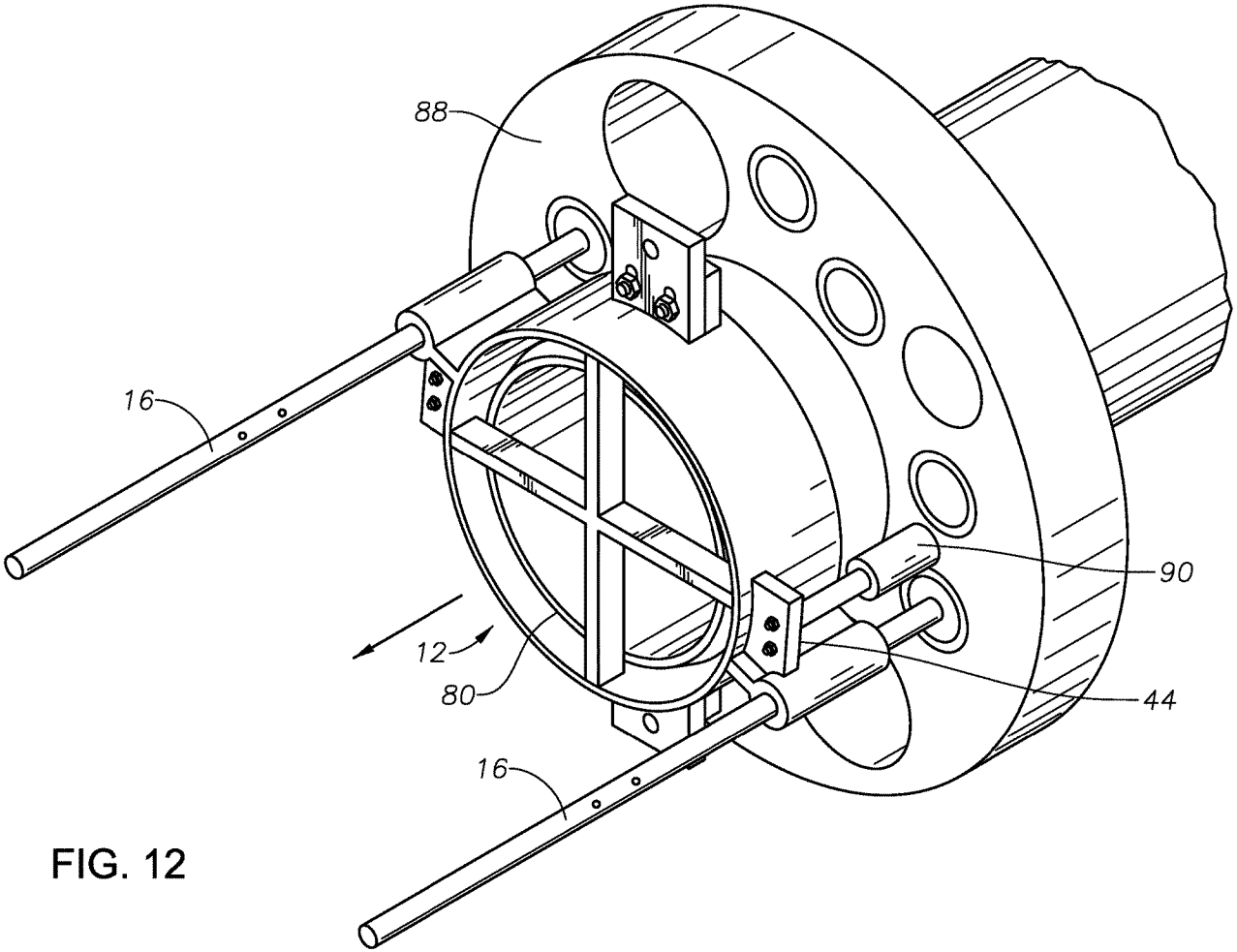
FIG. 12 is a sequential perspective view of the frame pulling the tubular member out of the central bore of the riser segment.

With reference to FIG. 10 again, hydraulic cylinder units 90 may then be positioned to engage outer surface 96 of riser flange 88. Activating and expanding hydraulic cylinder units 90 may force frame 12 to slide along tie rods 16 in a direction away from riser flange 88 as illustrated in FIG. 12. This movement of frame 12 pulls tubular 80 out of central bore 82 of riser segment 84 (partially or fully depending on the distance that hydraulic cylinder units 90 are expanded). Tubular 80 is secured within frame 12, which is suspended on tie rods 16 as shown in FIG. 12. Maintenance or repair work may be accomplished while tubular 80 and frame 12 are suspended on tie rods 16.

Subsequently (or initially) tubular 80 may be installed within central bore 82 by sliding frame 12 along tie rods 16 in a direction towards riser flange 88. This sliding movement may be manually provided by users pushing frame 12. Alternatively, hydraulic cylinder units 90 (or other hydraulic cylinder units) may be secured to a forward side of each mount surface 44 and to auxiliary apertures 98 through each tie rod 16. In this configuration, expansion of hydraulic cylinder units 90 may push frame 12 and tubular 80 along tie rods 16 in a direction towards riser flange 88 until tubular 80 is disposed within central bore 82. In the same manner, assembly 10 may be used to install a new or separate tubular within central bore 82.

Each apparatus, component, system, and assembly described herein may include any combination of the described components, features, and/or functions. Each method described herein may include any combination of the described steps in any order, including the absence of certain described steps. Any range of numeric values disclosed herein shall be construed to include any subrange therein.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

I claim:

1. A tubular handling assembly comprising:

a frame including:

a sleeve having an outer surface, an inner surface defining an internal space, a lateral aperture extending from the inner surface to the outer surface, and an end stop extending from the inner surface at least partially into the internal space at a first end of the sleeve; and an ear, two guides, and a mount surface each extending from the outer surface of the sleeve, wherein the ear is proximate the lateral aperture and includes an ear securing mechanism, wherein the guides are positioned opposite one another, each of the guides including a tubular frame with an internal bore;

a grip block including a first portion dimensioned to slide through the lateral aperture of the sleeve and a second portion including a grip securing mechanism configured to cooperate with the ear securing mechanism; and two tie rods each dimensioned to slidingly engage the internal bore of one of the guides, each of the tie rods including a first end configured to operatively engage an auxiliary bore of a riser flange.

2. The tubular handling assembly of claim 1, further comprising two adapter bushings each including a threaded inner bore and a partially threaded outer surface dimensioned to engage the auxiliary bore of the riser flange, and wherein the first end of each of the tie rods includes a threaded outer surface configured to engage the threaded inner bore of one of the adapter bushings.

3. The tubular handling assembly of claim 2, further comprising two tie rod nuts each including a threaded inner bore configured to engage the threaded outer surface of each of the tie rods to secure one of the tie rods within the threaded inner bore of one of the adapter bushings.

4. The tubular handling assembly of claim 1, wherein the ear securing mechanism and the grip securing mechanism each includes one or more openings.

5. The tubular handling assembly of claim 4, further comprising a second lateral aperture extending from the inner surface to the outer surface of the sleeve, a second ear extending from the outer surface of the sleeve proximate the second lateral aperture, and a second grip block including a first portion dimensioned to slide through the second lateral aperture of the sleeve and a second portion including a grip securing mechanism, wherein the second ear includes an ear securing mechanism configured to cooperate with the grip securing mechanism, wherein the ear securing mechanism of the second ear and the grip securing mechanism of the second grip block each includes one or more openings.

6. The tubular handling assembly of claim 5, wherein the ear and the second ear each further includes a lift opening.

7. The tubular handling assembly of claim 1, wherein the first portion of the grip block includes a curved end profile.

8. The tubular handling assembly of claim 1, wherein the mount surface is proximate one of the guides.

9. The tubular handling assembly of claim 1, further comprising a second mount surface extending from the outer surface of the sleeve, the second mount surface positioned opposite the mount surface, wherein the mount surface and the second mount surface are each configured to receive a hydraulic cylinder unit.

10. A tubular handling assembly comprising:

a frame including:

a sleeve having an outer surface, an inner surface defining an internal space, two lateral apertures each extending from the inner surface to the outer surface, and an end stop extending from the inner surface at least partially into the internal space at a first end of the sleeve; and two ears, two guides, and two mount surfaces each extending from the outer surface of the sleeve, wherein each of the ears is proximate one of the lateral apertures and includes an ear securing mechanism, wherein the guides are positioned opposite one another, each of the guides including a tubular frame with an internal bore;

two grip blocks each including a first portion dimensioned to slide through one of the lateral apertures of the sleeve and a second portion including a grip securing mechanism configured to cooperate with the ear securing mechanism, the first portion of each of the grip blocks including a curved end profile;

two adapter bushings each including a threaded inner bore and a partially threaded outer surface dimensioned to engage an auxiliary bore of a riser flange; and two tie rods each dimensioned to slidingly engage the internal bore of one of the guides, each of the tie rods including a first end with a threaded outer surface configured to engage the threaded inner bore of one of the adapter bushings.

11. The tubular handling assembly of claim 10, further comprising two tie rod nuts each including a threaded inner bore configured to engage the threaded outer surface of each of the tie rods to secure one of the tie rods within the threaded inner bore of one of the adapter bushings.

12. The tubular handling assembly of claim 10, wherein the ear securing mechanism and the grip securing mechanism each includes one or more openings.

13. A method of handling a tubular member disposed within a central bore of a riser segment, comprising:

a) providing a tubular handling assembly comprising: a frame including: a sleeve having an outer surface, an inner surface defining an internal space, a lateral aperture extending from the inner surface to the outer surface, and an end stop extending from the inner surface at least partially into the internal space at a first end of the sleeve, and an ear, two guides, and a mount surface each extending from the outer surface of the sleeve, wherein the ear is proximate the lateral aperture and includes an ear securing mechanism, wherein the guides are positioned opposite one another, each of the guides including a tubular frame with an internal bore; a grip block including a first portion dimensioned to slide through the lateral aperture of the sleeve and a second portion including a grip securing mechanism configured to cooperate with the ear securing mechanism, the first portion of the grip block including a first end; two adapter bushings each including a threaded inner bore and a partially threaded outer surface dimensioned to engage an auxiliary bore of a riser flange; and two tie rods each dimensioned to slidingly engage the internal bore of one of the guides, each of the tie rods including a first end with a threaded outer surface configured to engage the threaded inner bore of one of the adapter bushings;

b) securing each of the adapter bushings about each of the tie rods by engaging the threaded outer surface of each of the tie rods with the threaded inner bore of each of the adapter bushings;

c) securing each of the adapter bushings within an auxiliary bore of the riser segment by engaging a threaded inner surface of the auxiliary bore with the partially threaded outer surface of the adapter bushing;

d) suspending the frame with the tie rods by inserting each of the tie rods through the internal bore of each of the guides;

e) affixing a hydraulic cylinder unit to the mount surface to position the hydraulic cylinder unit between the mount surface and the riser segment;

f) sliding the frame along the tie rods to position a first end of the tubular member within the internal space of the frame such that the first end of the tubular member engages the end stop of the frame, wherein in this position an end of the hydraulic cylinder unit engages a flange surface of the riser segment;

g) sliding the grip block into the lateral aperture of the frame to engage a recess in an outer surface of the tubular member with the first end of the first portion of the grip block;

h) locking the frame to the tubular member by engaging the ear securing mechanism and the grip securing mechanism;

i) extending the hydraulic cylinder unit to slide the frame along the tie rods in a first direction away from the riser segment, thereby pulling the tubular member in a direction away from the central bore of the riser segment.

14. The method of claim 13, wherein step (h) further comprises sliding a bolt through an opening of the ear and through an opening of the grip block, and securing the bolt in place with a nut.

15. The method of claim 13, wherein the frame further includes a second lateral aperture extending from the inner surface to the outer surface of the sleeve, a second ear extending from the outer surface of the sleeve proximate the second lateral aperture, and a second grip block including a first portion and a second portion including a grip securing mechanism, the first portion of the second grip block including a first end, wherein the second ear includes an ear securing mechanism; wherein step (g) further comprises sliding the second grip block into the second lateral aperture of the frame to engage the recess of the tubular member with the first end of the first portion of the second grip block; and wherein step (h) further comprises engaging the ear securing mechanism of the second ear and the grip securing mechanism of the second grip block.

16. The method of claim 13, wherein step (b) further comprises threadedly connecting a tie rod nut to the threaded outer surface of each of the tie rods to secure each of the adapter bushings about each of the tie rods.

17. The method of claim 13, wherein the frame further includes a second mount surface, wherein step (e) further comprises affixing a second hydraulic cylinder unit to the second mount surface to position the second hydraulic cylinder unit between the second mount surface and the riser segment, and wherein step (i) further comprises extending the second hydraulic cylinder unit to slide the frame along the tie rods in the first direction.

18. The method of claim 13, wherein each of the tie rods includes one or more auxiliary apertures, the method further comprising:

j) connecting a hydraulic cylinder unit to one of the auxiliary apertures of one of the tie rods such that the frame is positioned between the hydraulic cylinder unit and the riser segment; and k) extending the hydraulic cylinder unit to slide the frame along the tie rods in a second direction toward the riser segment, thereby inserting the tubular member into the central bore of the riser segment.

* * * * *